US009059500B2

(12) United States Patent
Su et al.

(10) Patent No.: US 9,059,500 B2
(45) Date of Patent: Jun. 16, 2015

(54) CAPACITIVE LOOP ANTENNA AND ELECTRONIC DEVICE

(75) Inventors: Chi-Kang Su, Hsinchu (TW); Chia-Tien Li, Hsinchu (TW)

(73) Assignee: Wistron NeWeb Corporation, Hsinchu Science Park, Hsinchu (TW)

( * ) Notice: Subject to any disclaimer, the term of this patent is extended or adjusted under 35 U.S.C. 154(b) by 467 days.

(21) Appl. No.: 13/223,323

(22) Filed: Sep. 1, 2011

(65) Prior Publication Data

US 2012/0326941 A1 Dec. 27, 2012

(30) Foreign Application Priority Data

Jun. 22, 2011 (TW) ..... 100211354 U

(51) Int. Cl.
*H01Q 7/00* (2006.01)
*H01Q 1/38* (2006.01)

(52) U.S. Cl.
CPC ..... *H01Q 7/005* (2013.01); *H01Q 1/38* (2013.01); *H01Q 5/378* (2015.01)

(58) Field of Classification Search
CPC ..... H01Q 7/00
USPC ..... 343/866, 702
See application file for complete search history.

(56) References Cited

U.S. PATENT DOCUMENTS

2012/0188141 A1* 7/2012 Islam ..... 343/860
2012/0206302 A1* 8/2012 Ramachandran et al. .... 343/702
2013/0076576 A1* 3/2013 Avendal et al. ..... 343/702

FOREIGN PATENT DOCUMENTS

WO WO 2010/086496 A1 * 8/2010

* cited by examiner

*Primary Examiner* — Dameon E Levi
*Assistant Examiner* — Andrea Lindgren Baltzell
(74) *Attorney, Agent, or Firm* — Winston Hsu; Scott Margo

(57) ABSTRACT

A capacitive loop antenna is disclosed. The capacitive loop antenna comprises a shorting-to-ground terminal, for providing grounding, a feeding terminal, for receiving a first radio frequency feeding signal, and a first capacitive loop. The first capacitive loop comprises a first connection element, a first radiator, comprising an end electrically connected to the feeding terminal via the first connection element, to feed the first radio frequency feeding signal to the first radiator, a second connection element, and a second radiator, comprising an end electrically connected to the shorting-to-ground terminal via the second connection element. A first section of another end of the first radiator is capacitively coupled with the second radiator.

16 Claims, 7 Drawing Sheets

CAPACITIVE LOOP ANTENNA AND ELECTRONIC DEVICE

BACKGROUND OF THE INVENTION

1. Field of the Invention

The present invention relates to a capacitive loop antenna and electronic device, and more particularly, to a capacitive loop antenna and electronic device capable of achieving required bandwidth via adjusting capacitive coupling and having smaller size.

2. Description of the Prior Art

Since prosperous development of wireless communications in recent years, more and more information is transmitted through wireless networks and thus demands for wireless communications increases. Moreover, advance of laptop and pad computer technology also increases requirements for product outlook compact size thereof, and following the reduced antenna size.

A loop antenna is a conductor routed a shape of closed curve in a plane, the closed curve is usually routed as a circle, a square or a triangle, etc. The theory of the loop antenna is similar to that of a dipole antenna as a resonant antenna. Please refer to FIG. 1, which is a schematic diagram of a conventional loop antenna 10. As can be seen from FIG. 1, the loop antenna 10 is a circle-shaped conductor disposed in the x-y plane, and has a feature of low profile, such that a required dimension is smaller, and thus more suitable for wireless network card applications.

However, the conventional loop antenna has the feature of low profile, but the design is lack of flexibility and not easy to reduce antenna size. Therefore, how to improve the above disadvantages has become a goal of the industry.

SUMMARY OF THE INVENTION

It is therefore an object of the present invention to provide a capacitive loop antenna and electronic device via capacitive coupling to achieve required bandwidth and having smaller antenna size.

The present invention discloses a capacitive loop antenna including a shorting-to-ground terminal for providing grounding, a feeding terminal for receiving a first radio frequency feeding signal, and a first capacitive loop including a first connection element, a first radiator having an end electrically connected to the signal feeding terminal via the first connection element, to feed the first radio frequency feeding signal to the first radiator, a second connection element, and a second radiator, having an end electrically connected to the shorting-to-ground terminal via the second connection element, wherein a first section of an end of the first radiator is capacitively coupled with the second radiator.

The present invention further discloses an electronic device including a radio frequency processing unit for processing a first radio frequency feeding signal, and a capacitive loop antenna including a shorting-to-ground terminal for providing grounding, a signal feeding terminal for receiving the first radio frequency feeding signal, and a first capacitive loop including a first connection element, a first radiator having an end electrically connected to the signal feeding terminal via the first connection element to feed the first radio frequency feeding signal to the first radiator, a second connection element, and a second radiator having an end electrically connected to the shorting-to-ground terminal via the second connection element, wherein a first section of an end of the first radiator is capacitively coupled with the second radiator.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
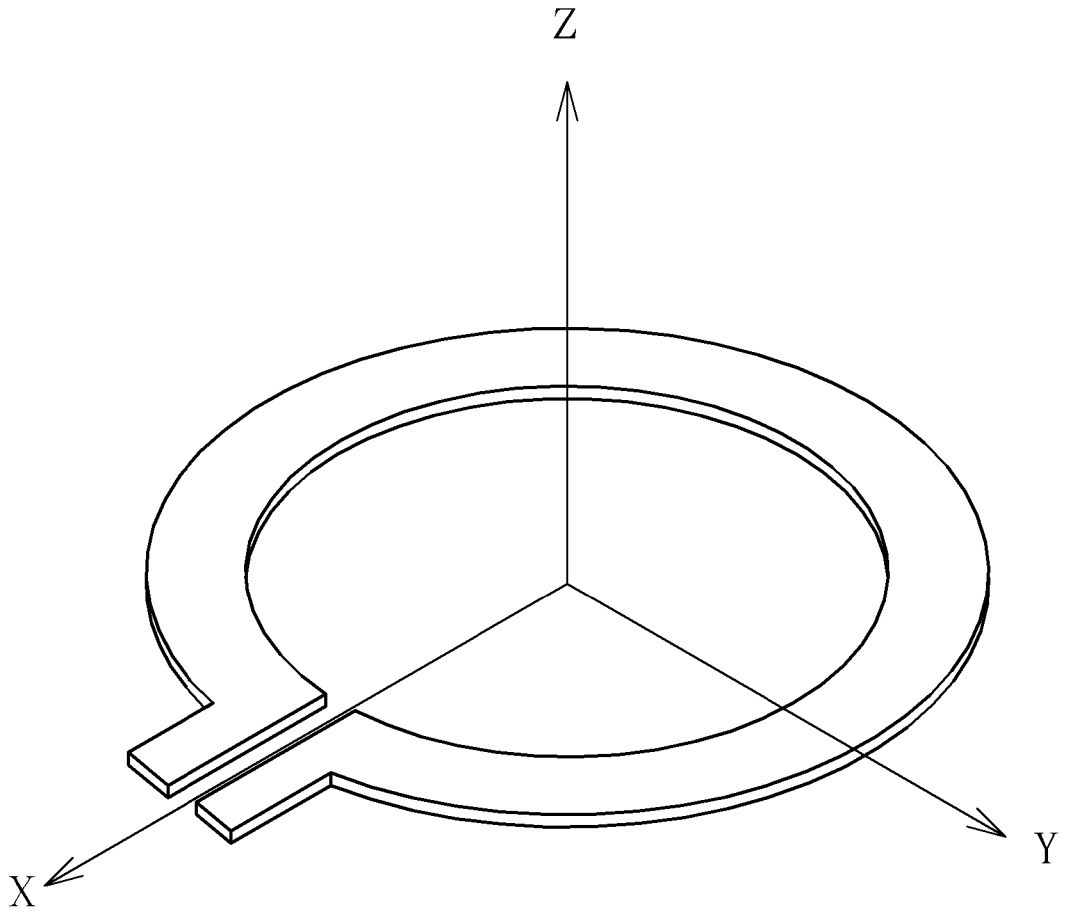
FIG. 1 PRIOR ART
FIG. 1 is a schematic diagram of a conventional loop antenna.
Figure 2A:
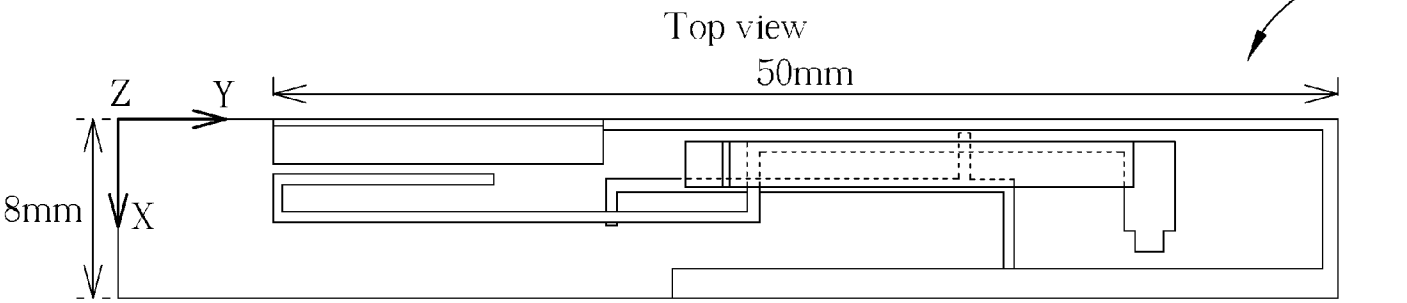
FIG. 2A to FIG. 2D are schematic diagrams of top view diagram, side view diagram and structure of a first layer and a second layer of a capacitive loop antenna according to an embodiment of the present invention, respectively.
Figure 2B:
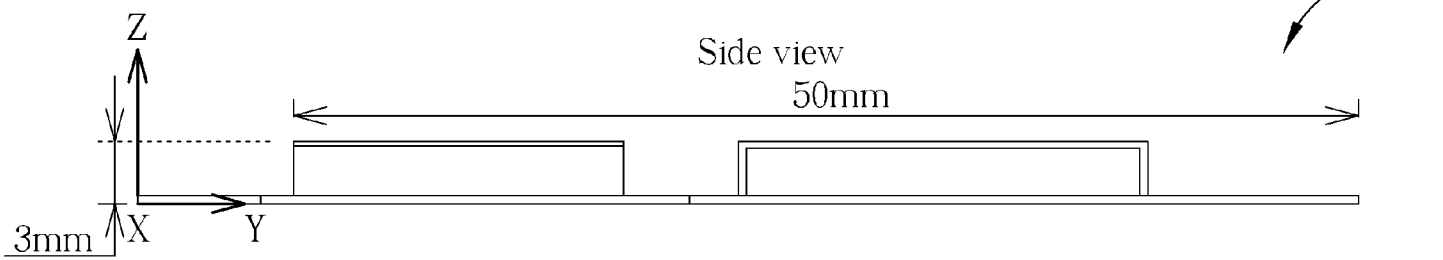
Figure 2C:
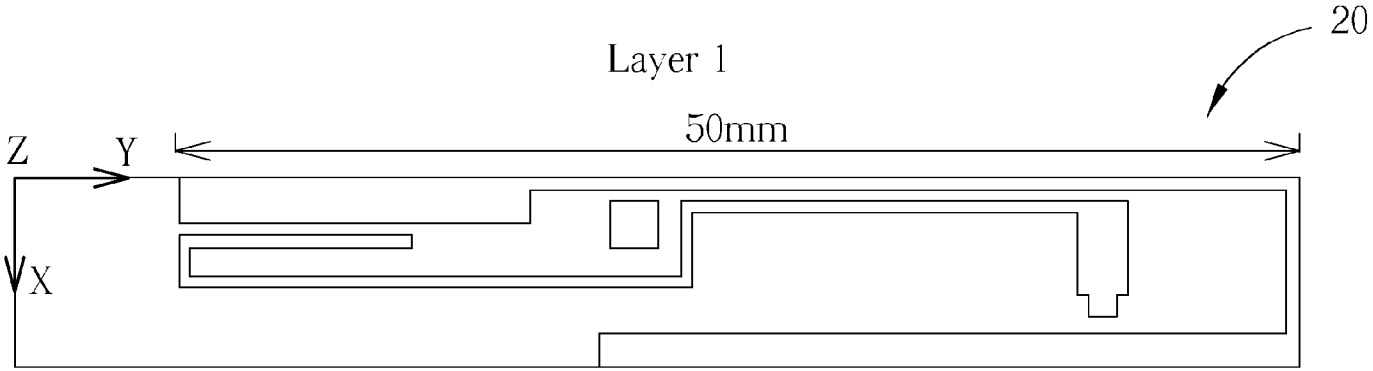
Figure 2D:
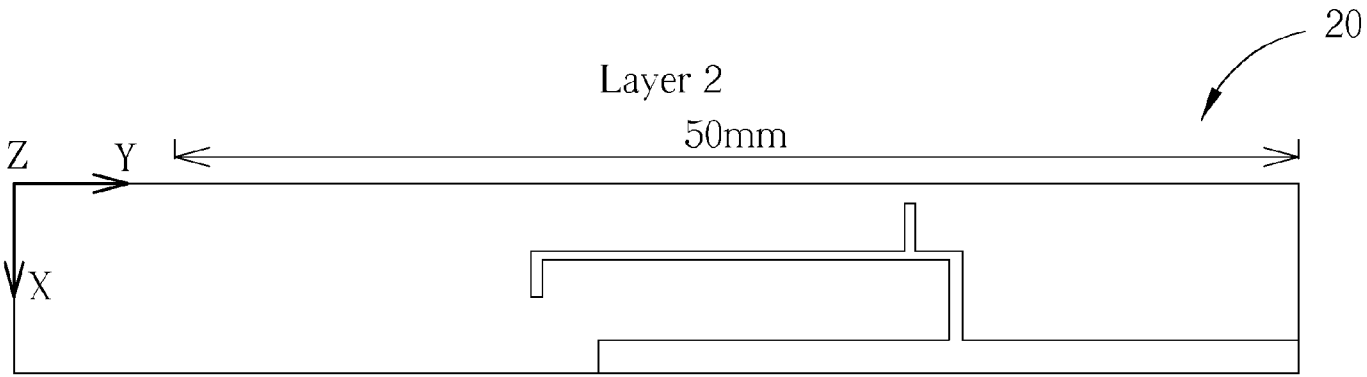
Figure 2E:
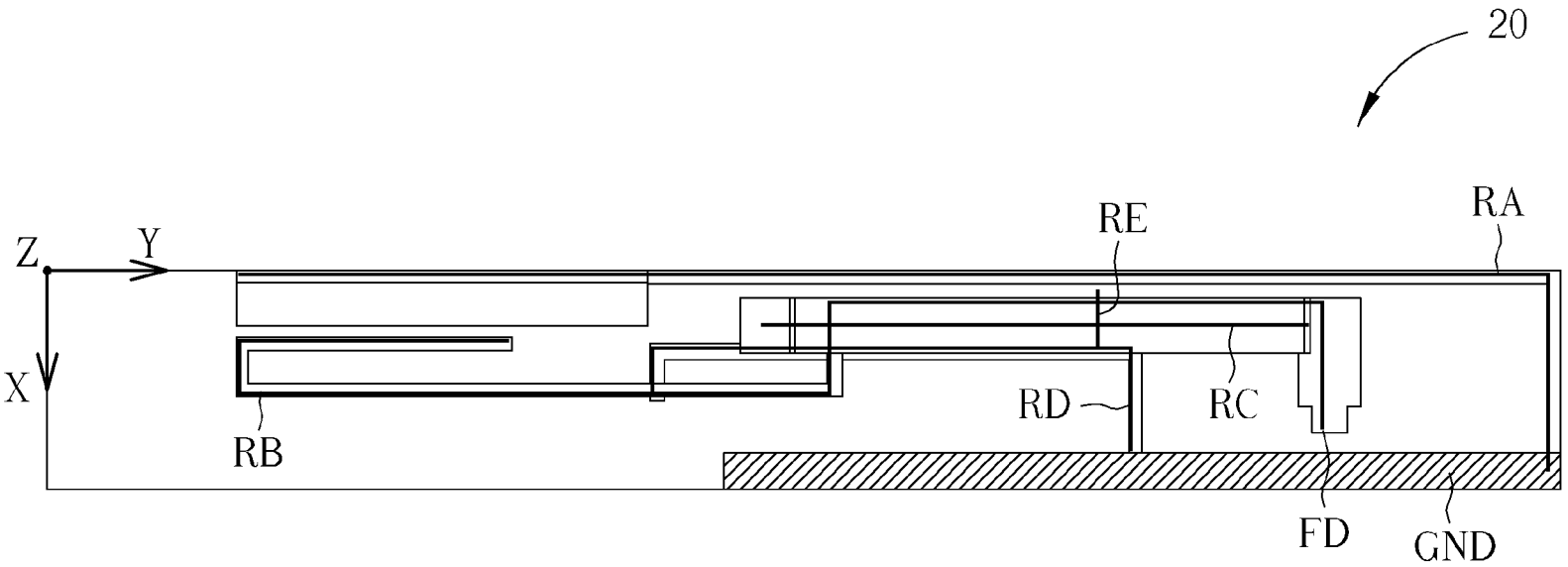
FIG. 2E is a schematic diagram of an antenna structure of the capacitive loop antenna.

Please refer to FIG. 2A to FIG. 2D, which are schematic diagrams of a top view, a side view and a first layer and a second layer of a capacitive loop antenna 20 according to an embodiment of the present invention, respectively. FIG. 2E is a schematic diagram of an antenna structure of the capacitive loop antenna 20. Please refer to FIG. 2E together with FIG. 2A to FIG. 2D to clearly understand the antenna structure of the capacitive loop antenna 20. As shown in FIG. 2E, the capacitive loop antenna 20 includes a shorting-to-ground terminal GND, a signal feeding terminal FD, capacitive loops CL1 and CL2. The capacitive loop CL1 includes connection elements CE1 and CE2 (not shown) and radiators RA and RB, and the capacitive loop CL2 includes connection elements CE3 and CE4 (not shown) and radiators RC and RD. In short, the present invention can achieve the required bandwidth of high frequency and low frequency by adjusting capacitive coupling between the radiators RA and RB and capacitive coupling between the radiators RC and RD, and has smaller antenna size.

Figure 2F:
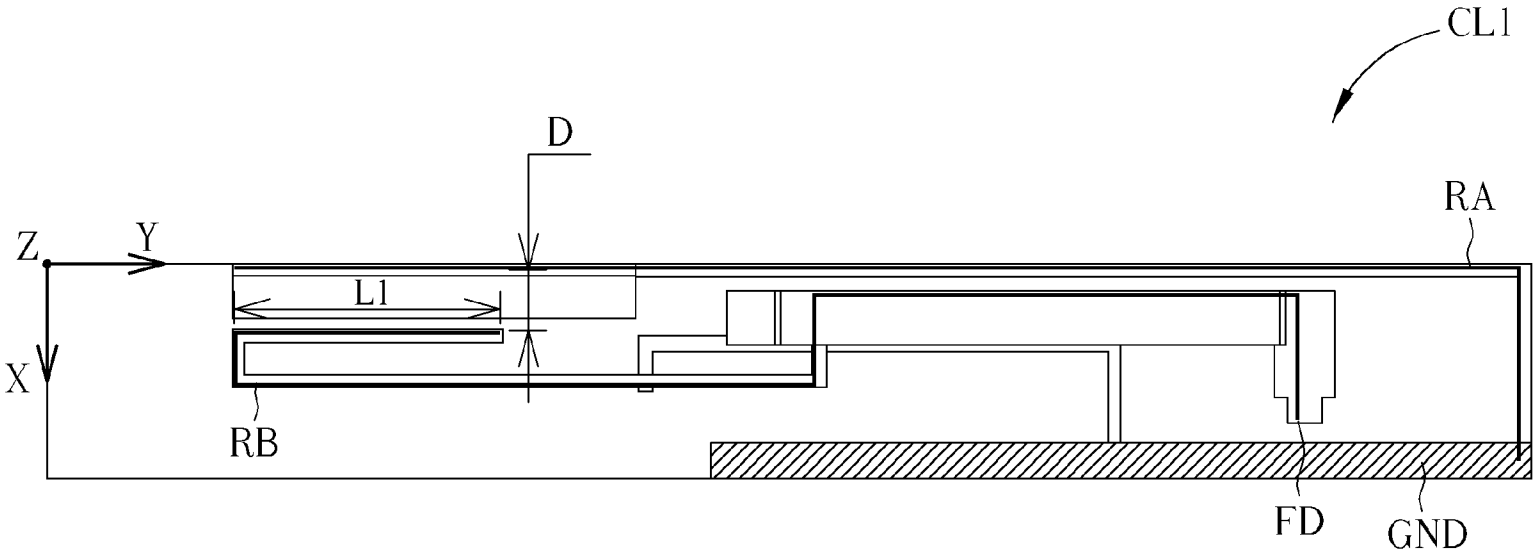
FIG. 2F and FIG. 2G are schematic diagrams of the two capacitive loops shown in FIG. 2E, respectively.
Figure 2G:
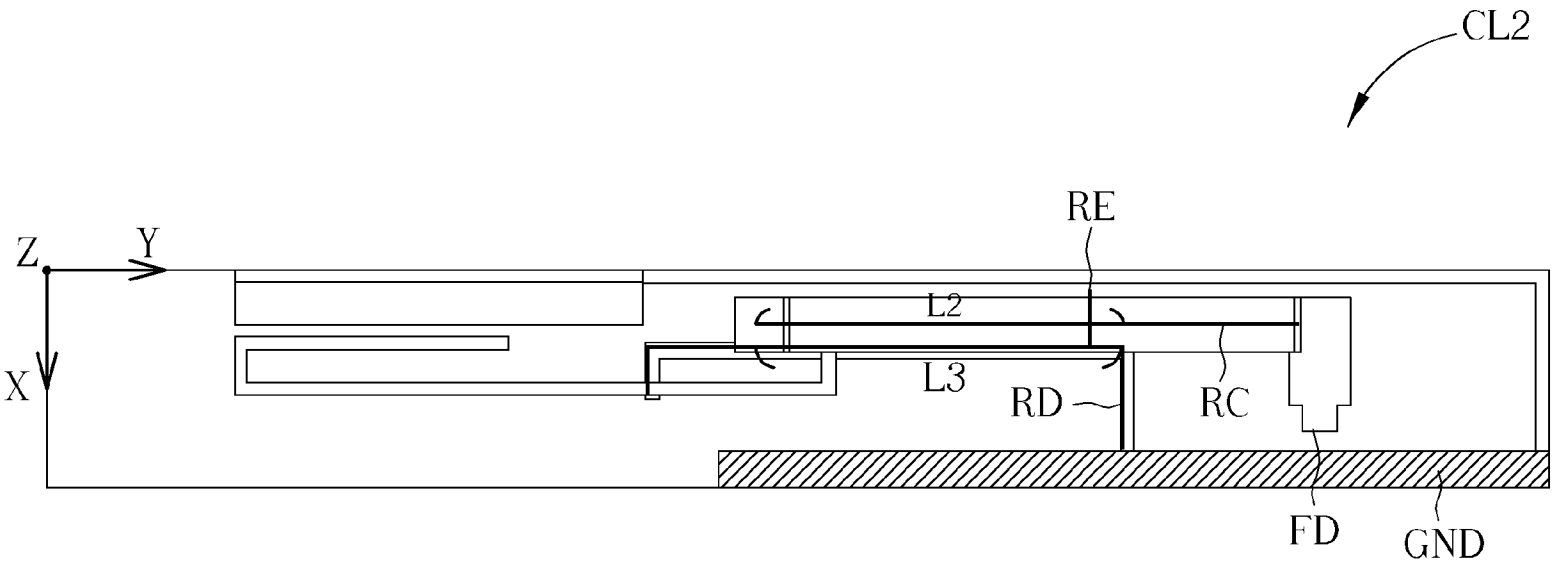

In detail, please refer to FIG. 2F and FIG. 2G, which are schematic diagrams of the capacitive loops CL1 and CL2, respectively. As shown in FIG. 2F, the shorting-to-ground terminal GND provides grounding to the radiator RA. The signal feeding terminal FD receives the radio frequency feeding signal RF1. An end of the radiator RB is electrically connected to the signal feeding terminal FD via the connection element CE1, so as to feed the radio frequency feeding signal RF1 to the radiator RB. An end of the radiator RA is electrically connected to the shorting-to-ground terminal GND via the connection element CE2. A section L1 of another end of the radiator RB is capacitively coupled with the radiator RA. When materials of the radiator RA and the signal feeding terminal FD are different, the connection element CE1 is a material for electrically connecting the radiator RA and the signal feeding terminal FD, e.g. soldering. When the materials of the radiator RA and the signal feeding terminal FD are identical, the connection element CE1 is a partition between the radiator RA and the signal feeding terminal FD. When materials of the radiator RB and the shorting-to-ground terminal GND are different, the connection element CE2 is a material for electrically connecting the radiator RB and the shorting-to-ground terminal GND, e.g. soldering. When the materials of the radiator RB and the shorting-to-ground terminal GND are identical, the connection element CE2 is a partition between the radiator RB and the shorting-to-ground terminal GND. In such a structure, different capacitances are derived by adjusting the length of the section L1, or by adjusting the distance D between the section L1 and the radiator RA, so as to adjust a bandwidth of the capacitive loop CL1 according to practical requirements, and thus antenna design is more flexible. Besides, compared with a complete loop of the loop antenna 10, the present invention forms the capacitive loop CL1 via capacitive coupling, so that a sum of lengths of the radiator RB and the radiator RA is less than a half wavelength of the radio frequency feeding signal RF1 required for a conventional loop antenna, and thus to achieve antenna size reduction. As a result, the capacitive loop CL1 of the present invention can achieve low frequency bandwidth and have smaller antenna size via capacitive coupling.

On the other hand, As shown in FIG. 2G, the shorting-to-ground terminal GND provides grounding to the radiator RD. The signal feeding terminal FD receives the radio frequency feeding signal RF2 An end of the radiator RC is electrically connected to the signal feeding terminal FD via the connection element CE3, so as to feed the radio frequency feeding signal RF1 to the radiator RC. An end of the radiator RD is electrically connected to the shorting-to-ground terminal GND via the connection element CE4. A section L2 of another end of the radiator RC is capacitively coupled with the radiator RA, and a frequency of the radio frequency feeding signal RF2 is greater than a frequency of the radio frequency feeding signal RF1. When materials of the radiator RC and the signal feeding terminal FD are different, the connection element CE3 is a material for electrically connecting the radiator RC and the signal feeding terminal FD, e.g. soldering. When the materials of the radiator RC and the signal feeding terminal FD are identical, the connection element CE4 is a partition between the radiator RC and the signal feeding terminal FD. When materials of the radiator RD and the shorting-to-ground terminal GND are different, the connection element CE4 is a material for electrically connecting the radiator RD and the shorting-to-ground terminal GND, e.g. soldering. When the materials of the radiator RD and the shorting-to-ground terminal GND are identical, the connection element CE4 is a partition between the radiator RD and the shorting-to-ground terminal GND. In such a structure, a loop position for the best radiating characteristic can be found via adjusting a position of the radiator RD, i.e. adjusting the length of the section L2 via shifting the radiator RD to the left and right, so as to generate different capacitance, which can adjust the bandwidth of the capacitive loop CL2 according to practical requirements, and thus the antenna design is more flexible. Besides, comparing with a complete loop of the loop antenna 10, the present invention also forms the capacitive loop CL2 via capacitive coupling, and thus a sum of lengths of the radiator RC and the radiator RD is less than the half wavelength of the radio frequency feeding signal RF2 required for the conventional loop antenna as well, so as to achieve antenna size reduction. As a result, the capacitive loop CL2 of the present invention can achieve the required high frequency bandwidth and have smaller antenna size via capacitive coupling.

Besides, the capacitive loop antenna 20 can further include a radiator RE in a plane with the radiator RD, and vertically formed on a section L3 of the radiator RD capacitively coupled with the section L2. As a result, different capacitances can be derived through adjusting a length and a position of the radiator RE, i.e. shifting the position of the radiator RE on the section L3 to the left and right, so as improve the bandwidth and matching at high frequency.

Figure 3:
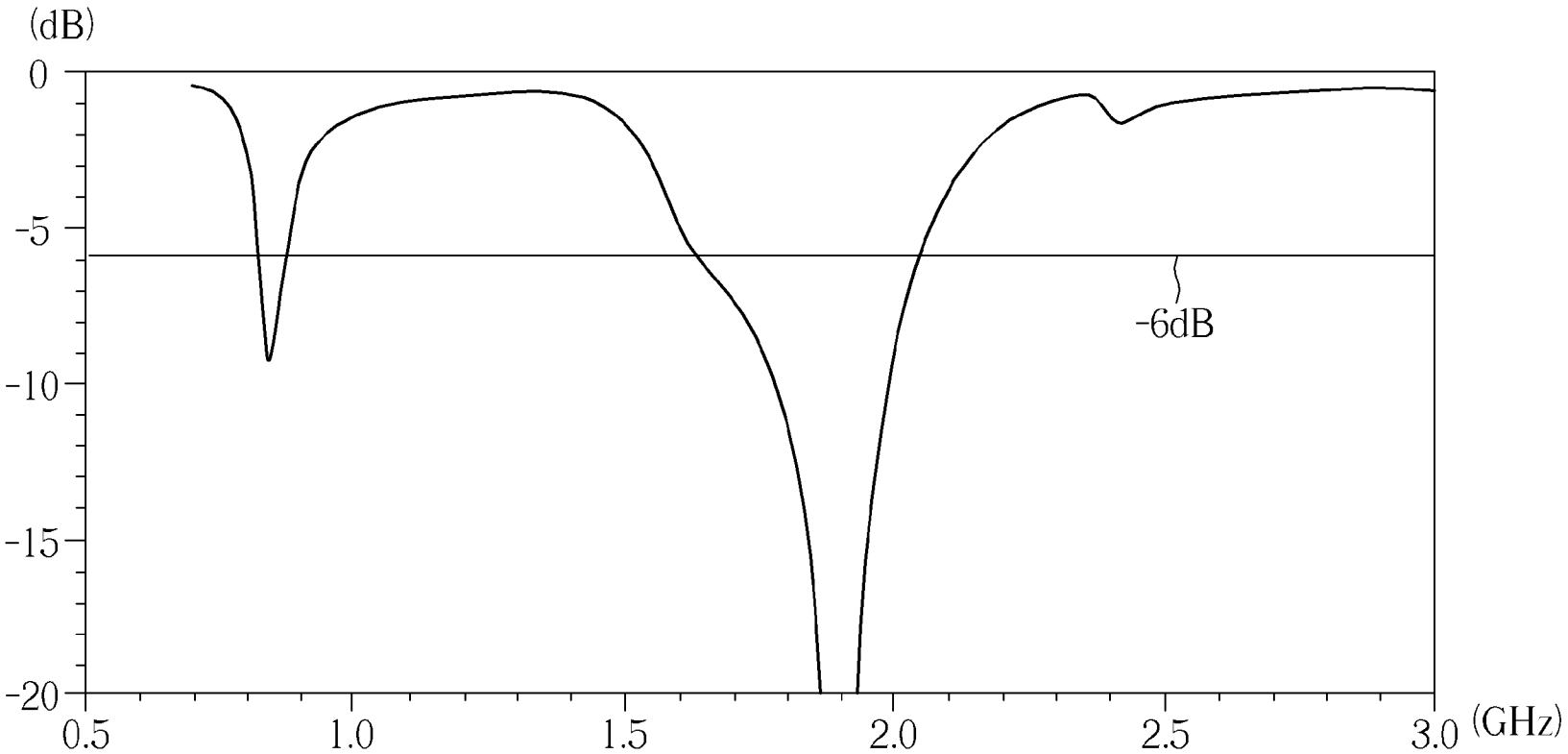
FIG. 3 is a schematic diagram of a return loss of the capacitive loop antenna shown in FIG. 2E.

Please refer to FIG. 3, which is a schematic diagram of a return loss, i.e. S11 parameter, of the capacitive loop antenna 20 shown in FIG. 2E. As shown in FIG. 3, the return loss less of the capacitive loop antenna 20 is less than −6 dB within a low frequency band and a high frequency band, which are operating frequency bands of the capacitive loops CL1 and CL2, respectively. As a result, the capacitive loop antenna 20 can have two resonant modes corresponding to low frequency and high frequency, respectively, via combining the capacitive loops CL1 and CL2.

Noticeably, the spirit of the present invention is that the capacitive loop antenna 20 can achieve the required high frequency band and low frequency band via adjusting the capacitive coupling between the radiators RA and RB and between the radiators RC and RD and has smaller antenna size. In addition, those skilled in the art should make modifications or alterations accordingly, and not limited to this. For example, the present invention achieves the required low frequency band via adjusting the capacitive coupling between the radiators RA and RB of the capacitive loop CL1, and achieves the required high frequency band via adjusting the capacitive coupling between the radiators RC and RD of the capacitive loop CL2, so as to have the high frequency band and the low frequency band at the same time. Thus, the present invention can be applied to mobile electronic devices, such as laptops, pad computers, mobile phones or e-books. However, in practice, it may utilize only one of the capacitive loops CL1 and CL2 to have either the high frequency band or l the low frequency band. Besides, the capacitive loop antenna 20 can also be applied to other electronic devices, as long as the electronic devices include a radio frequency process unit which can process, transmit or receive radio frequency signals.

On the other hand, the radiators RA, RB, RC, RD of the capacitive loop CL1 and CL2 can be designed to have at least one turning. Furthermore, the size and the material of the capacitive loop antenna 20 are not limited to any specific type, and those skilled in the art should make proper modifications and adjustments according to the system requirements, so as to meet requirements of the operating frequency band.

In the prior art, the loop antenna has a feature of low profile, but antenna design is lack of flexibility and not easy for size reduction. In comparison, the capacitive loop antenna 20 of the present invention can achieve the high frequency band and the low frequency band via adjusting the capacitive coupling between the radiators RA and RB and between the radiators RC and RD, and has smaller antenna size.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A capacitive loop antenna, comprising:

a shorting-to-ground terminal, for providing grounding;

a feeding terminal, for receiving a first radio frequency feeding signal; and a first capacitive loop, comprising:

a first connection element;

a first radiator, comprising an end electrically connected to the signal feeding terminal via the first connection element, to feed the first radio frequency feeding signal to the first radiator;

a second connection element; and a second radiator, comprising an end electrically connected to the shorting-to-ground terminal via the second connection element;

wherein a first section of another end of the first radiator is capacitively coupled with the second radiator to form a first electric loop from the end of the first radiator to the end of the second radiator;

wherein the signal feeding terminal is further utilized for receiving a second radio frequency feeding signal with a frequency different from a frequency of the first radio frequency feeding signal, and the capacitive loop antenna further comprises a second capacitive loop, comprising:

a third connection element;

a third radiator, comprising an end electrically connected to the signal feeding terminal via the third connection element, to feed the second radio frequency feeding signal to the third radiator;

a fourth connection element; and a fourth radiator, comprising an end electrically connected to the shorting-to-ground terminal via the fourth connection element;

wherein a second section of another end of the third radiator is capacitively coupled with the fourth radiator to form a second electric loop from the end of the third radiator to the end of the fourth radiator;

wherein the third radiator is formed in a first layer, the first radiator and the second radiator are formed in a second layer, the fourth radiator is formed in a third layer, and the first layer, the second layer and the third layer are different layers and are in different planes.

2. The capacitive loop antenna of claim 1, wherein a bandwidth of the first capacitive loop is adjusted by adjusting a length of the first section.

3. The capacitive loop antenna of claim 1, wherein a bandwidth of the first capacitive loop is adjusted by adjusting a distance between the first section and the second radiator.

4. The capacitive loop antenna of claim 1, wherein a sum of lengths of the first radiator and the second radiator is less than a half wavelength of the first radio frequency feeding signal.

5. The capacitive loop antenna of claim 1, wherein the first radiator and the second radiator have at least one turning, respectively.

6. The capacitive loop antenna of claim 1, wherein the frequency of the second radio frequency feeding signal is greater than the frequency of the first radio frequency feeding signal.

7. The capacitive loop antenna of claim 1 further comprising a fifth radiator in a same plane with the fourth radiator, and vertically formed on a third section of the fourth radiator capacitively coupled with the second section.

8. The capacitive loop antenna of claim 7, wherein a bandwidth of the second capacitive loop is adjusted by adjusting a position and a length of the fifth radiator.

9. An electronic device, comprising:

a radio frequency processing unit, for processing a first radio frequency feeding signal; and a capacitive loop antenna, comprising:

a shorting-to-ground terminal, for providing grounding;

a signal feeding terminal, for receiving the first radio frequency feeding signal; and a first capacitive loop, comprising:

a first connection element;

a first radiator, comprising an end electrically connected to the signal feeding terminal via the first connection element, to feed the first radio frequency feeding signal to the first radiator;

a second connection element; and a second radiator, comprising an end electrically connected to the shorting-to-ground terminal via the second connection element;

wherein a first section of another end of the first radiator is capacitively coupled with the second radiator to form a first electric loop from the end of the first radiator to the end of the second radiator;

wherein the radio frequency processing unit is further utilized for processing a second radio frequency feeding signal with a frequency different from the frequency of the first radio frequency feeding signal, the signal feeding terminal is further used for receiving the second radio frequency feeding signal, and the capacitive loop antenna further comprises a second capacitive loop, comprising:

a third connection element;

a third radiator, comprising an end electrically connected to the signal feeding terminal via the third connection element, to feed the second radio frequency feeding signal to the third radiator;

a fourth connection element; and a fourth radiator, comprising an end electrically connected to the shorting-to-ground terminal via the fourth connection element;

wherein an end of a second section of the third radiator is capacitively coupled with the fourth radiator to form a second electric loop from the end of the third radiator to the end of the fourth radiator;

wherein the third radiator is formed in a first layer, the first radiator and the second radiator are formed in a second layer, the fourth radiator is formed in a third layer, and the first layer, the second layer and the third layer are different layers and are in different planes.

10. The electronic device of claim 9, wherein a bandwidth of the first capacitive loop is adjusted by adjusting a length of the first section.

11. The electronic device of claim 9, wherein the bandwidth of the first capacitive loop is adjusted by adjusting a distance between the first section and the second radiator.

12. The electronic device of claim 9, wherein a sum of lengths of the first radiator and the second radiator is less than a half wavelength of the first radio frequency feeding signal.

13. The electronic device of claim 9, wherein the first radiator and the second radiator have at least one turning, respectively.

14. The electronic device of claim 9, wherein the frequency of the second radio frequency feeding signal is greater than the frequency of the first radio frequency feeding signal.

15. The electronic device of claim 9, further comprising a fifth radiator in a same plane with the fourth radiator, and vertically formed on a third section of the fourth radiator and capacitively coupled with the second section.

16. The electronic device of claim 15, wherein a bandwidth of the second capacitive loop can is adjusted by adjusting a position and a length of the fifth radiator.

* * * * *